United States Patent [19]

Blehert

[11] Patent Number: 4,466,156

[45] Date of Patent: Aug. 21, 1984

[54] AIR VELOCITY CONTROL MECHANISM FOR SELECTIVE DEBRIS PICKUP

[75] Inventor: Michael L. Blehert, Crystal, Minn.

[73] Assignee: Tennant Company, Minneapolis, Minn.

[21] Appl. No.: 459,237

[22] Filed: Jan. 19, 1983

[51] Int. Cl.[3] ..... E01H 1/08

[52] U.S. Cl. ..... 15/346

[58] Field of Search ..... 15/340, 345, 346

[56] References Cited

U.S. PATENT DOCUMENTS

| | | | |
|---|---|---|---|
| 2,932,845 | 4/1960 | Rydberg . | |
| 3,054,130 | 9/1962 | Ferrari . | |
| 3,512,206 | 5/1970 | Young . | |
| 3,545,181 | 12/1970 | Young . | |
| 3,662,427 | 5/1972 | Hanna . | |
| 4,099,290 | 7/1978 | Hiszpanski | 15/346 X |
| 4,110,864 | 9/1978 | Gunnarsson . | |
| 4,359,801 | 11/1982 | Tate | 15/346 |

*Primary Examiner*—Chris K. Moore

*Attorney, Agent, or Firm*—Merchant, Gould, Smith, Edell, Welter & Schmidt

[57] ABSTRACT

An air flow control mechanism is provided in the debris pick-up head (10) of a sweeper to allow selective sweeping of debris. The pick-up head (10) is provided a center skirt (70) which partitions the head interior into two sweeping chambers, a rearward chamber (74) and a forward chamber (75). A filler piece (76) in the rearward chamber (74) lowers the ceiling of the chamber (74) sufficiently to create an air flow velocity differential between the two chambers. Forced air flow directed into the rearward chamber (74) becomes high-velocity, air flow capable of transporting relatively heavy debris to a suction outlet (66) for removal to a collection hopper (13). The forward chamber (75) has low-velocity air flow therethrough for sweeping relatively lighter debris to the suction outlet (66). The air flow control mechanism is adjustable to allow effective sweeping for various combinations of debris densities and sizes. Further, a nozzle-like head (63) introduces the forced air into the pick-up head (10) in a manner which induces the air flow to swirl about the area prior to flowing into the rearward chamber (74) thus achieving a sweeping path the full width of the pick-up head.

14 Claims, 7 Drawing Figures

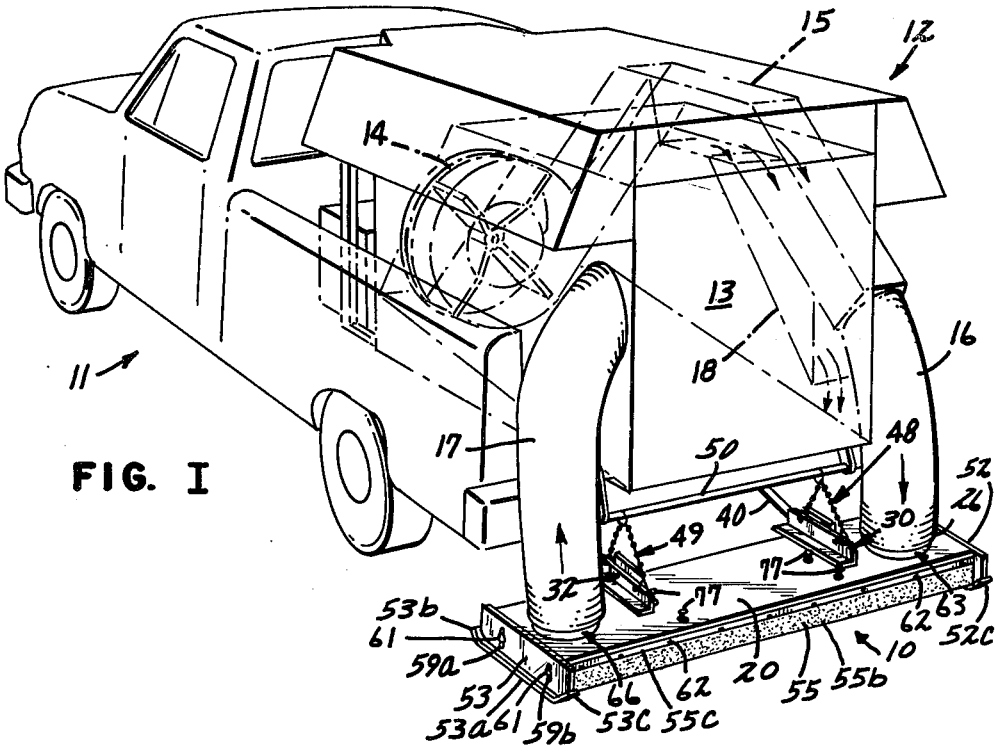
FIG. I
FIG. II
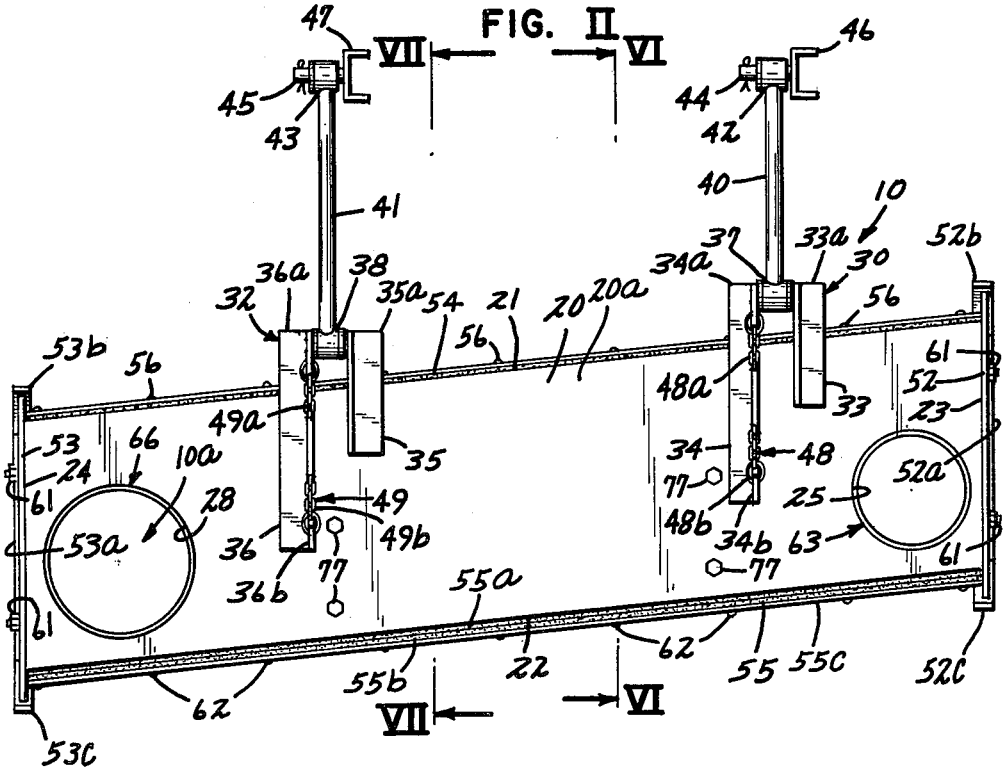

FIG. III
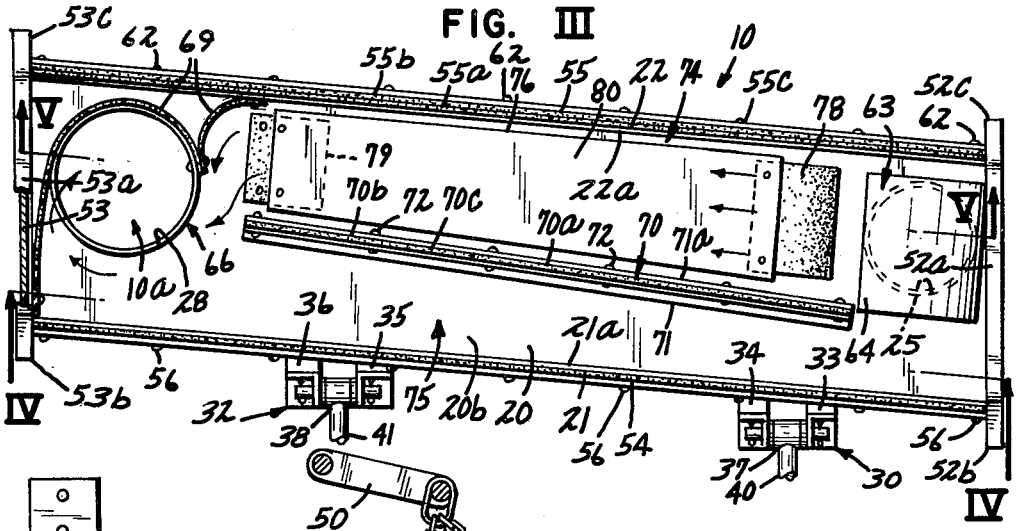
FIG. VI
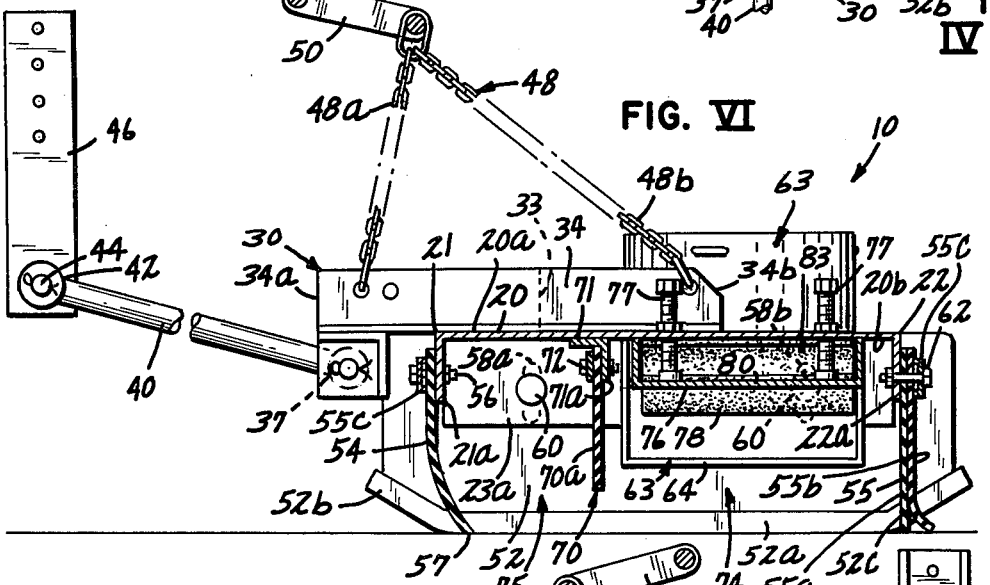
FIG. VII
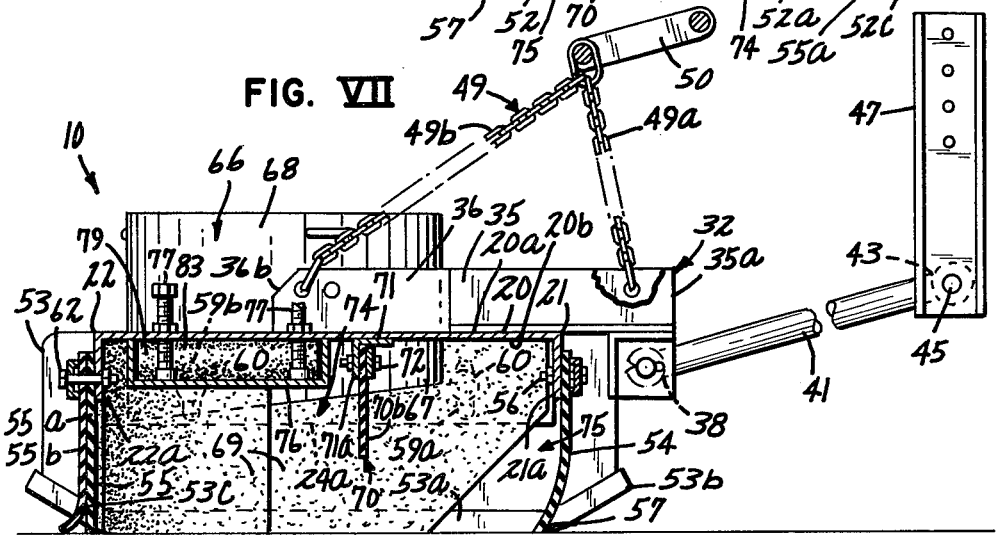

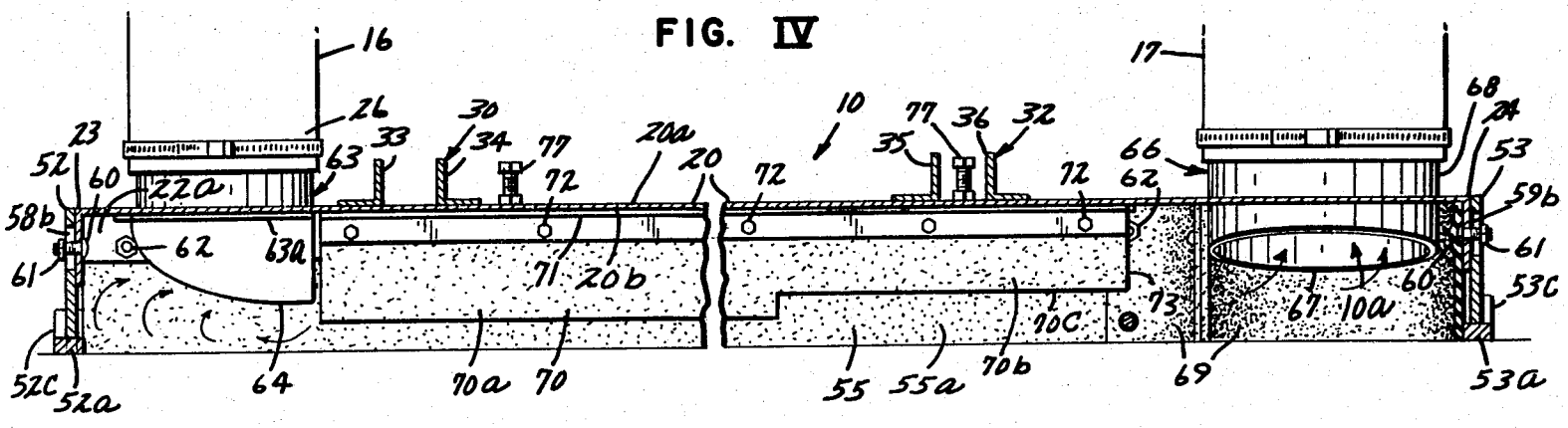
FIG. IV
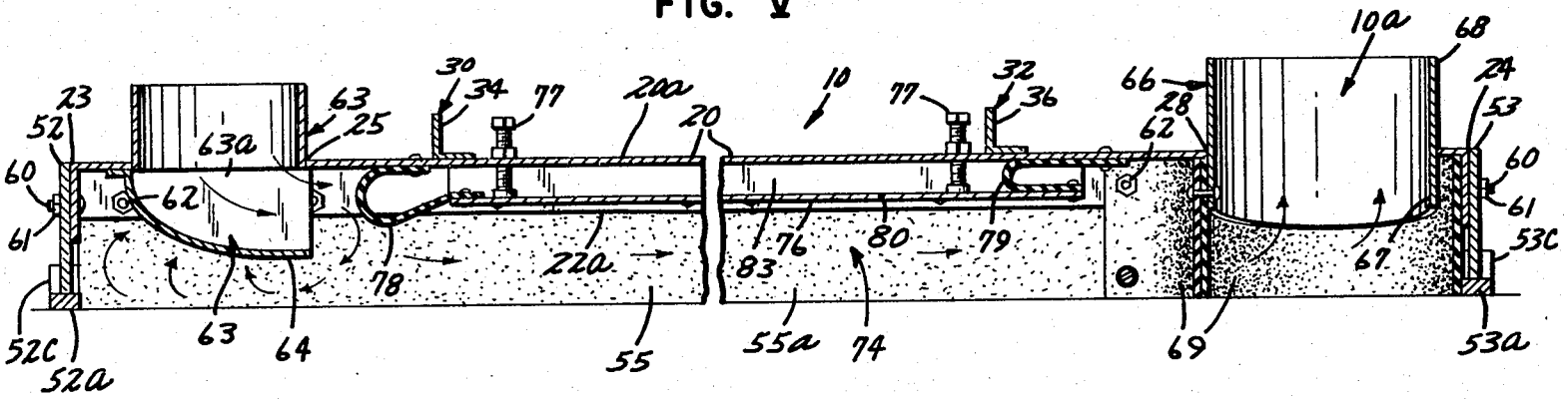
FIG. V

AIR VELOCITY CONTROL MECHANISM FOR SELECTIVE DEBRIS PICKUP

TECHNICAL FIELD

The present invention relates to industrial sweepers used to remove debris from a ground surface, and more particularly to a pick-up head on an air sweeper which has an air velocity control mechanism for selective debris pick up.

BACKGROUND

To remove debris from a surface such as a parking lot, city street, and the like, mobile, truck or trailer mounted sweepers may be used. Such sweepers typically use forced air currents, rotating brushes or a combination of air currents and brushes to sweep the debris from the surface and into a hopper for collection. Known prior art sweepers generally do a satsifactory job of removing most, if not all, of the debris. However, certain problems remain due to the varying nature of the debris found in parking lots, city streets, and the like. While one type of sweeper may be excellent for removing relatively light, low density debris, e.g., paper and dust, it may be incapable of picking up heavier debris, e.g., broken glass, sand and gravel. Oftentimes the design of certain prior art sweepers allows the forced air currents to concentrate above the ground surface, thereby leaving the heavier debris on the ground undisturbed. This shortcoming has been overcome in many prior art sweepers by increasing the system's airflow and adding dust control skirting. The increased airflow consumes excess power and accelerates the wear of the airflow systems components.

The present invention is believed to overcome the shortcomings of the known prior art in that it allows a single pick-up head in a single pass over a surface to simultaneously pick up debris of varying sizes and densities by controlling air velocity without increasing the total system cubic feet per minute air flow and power consumption. An air velocity control mechanism is provided in the pick-up head which allows selective removal of a wide range of debris sizes and densities. Further, the invention provides an increase in breadth of the sweeping path, in that the construction and arrangement of the pick-up head allows the forced air flow to sweep the full width of the pick-up head.

SUMMARY OF THE INVENTION

The present invention improves the capability of a sweeper pick-up head using forced air currents to simultaneously remove heavy and light debris from a surface. This is accomplished by the partitioning of the pick-up head interior into a high-velocity air sweeping chamber and a low-velocity air sweeping chamber. Relatively heavy debris is picked up in the high-velocity chamber by the forced air flow moving along the surface of the ground being swept in a direction transverse to the movement of the sweeper. Lighter debris becomes entrained in the air flow found in the low-velocity portion of the pick-up head and also moves along a flow path transverse to the movement of the sweeper. A single debris outlet serves the pick-up head to remove by suction both the heavy and light debris to a hopper for collection. The forced air is directed into the high-velocity portion of the head, but not into the low-velocity portion, through an inlet located at an end of the pick-up head opposite the location of the debris outlet.

Preferably, the velocity differential between the two chambers is created by positioning a filler piece within a rearward or trailing portion of the head between the air flow inlet and the debris outlet and by directing most of the forced air into the rearward portion. The filler piece essentially lowers the ceiling of the pick-up head in this portion creating a reduced volume area in which the forced air flow must travel in its transverse movement to the debris outlet. This creates the high-velocity sweeping chamber. Further, a centrally located skirt having a low ground clearance substantially partitions the portion of the head containing the filler piece from the remaining forward or leading portion of the pick-up head. The presence of the center skirt concentrates the forced air stream in the rear portion to keep the flow area minimized for optimum pick up of heavy debris. The center skirt further assists in the entry and pick up of lighter debris in the low-velocity sweeping chamber or front portion of the pick-up head by separating the forced air flow apart from this area and by reducing the blow-out of high velocity air flow against the entering light debris. A zone of suction is thus created in the low-velocity chamber to draw atmospheric air and debris into the front portion of the pick-up head.

Additionally, to provide an even greater range in the velocity differential within the pick-up head a mechanism for adjusting a filler piece in the head may be provided. Alternatively, adjustment of the height of the pick-up head top wall relative to the surface of the ground being swept may be provided. This allows an adjustment to be made if necessary when the density and size of debris varies significantly from one surface to another in order to maintain the efficient debris pick-up of the invention.

Further, it is preferable to also provide at the forced air flow inlet, structure which induces the entering air flow to swirl and sweep around the inlet area prior to moving across the head to the debris outlet. Such structure would provide an impingement area which restricts the flow of the entering air thus causing it to be turbulent around the inlet area. In this manner, a sweeping path the full width of the pick-up head is achieved.

Further advantages and features of the present invention will be discussed in the detailed description which follows.

BRIEF DESCRIPTION OF THE DRAWINGS

FIG. I is a perspective view of a bed-mounted sweeper having a pick-up head positioned adjacent the ground for sweeping.

FIG. II is a top plan view of the sweeper pick-up head shown in FIG. I which includes the present invention therein.

FIG. III is a bottom plan view of the sweeper pick-up head seen in FIG. II as it would appear looking upwardly from beneath the pick-up head.

FIG. IV is a view in cross-section of the sweeper head as seen generally along lines IV—IV in FIG. III.

FIG. V is a view in cross-section of the sweeper head and as seen generally along lines V—V in FIG. III.

FIG. VI is a view in cross-section of the sweeper head as seen generally along lines VI—VI in FIG. II.

FIG. VII is a view in cross-section of the sweeper as seen generally along lines VII—VII in FIG. II.

DETAILED DESCRIPTION OF A PREFERRED EMBODIMENT OF THE PRESENT INVENTION

One preferred embodiment of the present invention, shown in FIGS. I and II., includes a sweeper 12 mounted in the box of a pick-up truck 11. The sweeper 12 has a debris pick-up head 10 located to the rear of a vehicle 11. Sweeper 12 further has a debris collection area of hopper 13. Sweeper 12 includes a fan 14 which provides a flow of air through a conduit 15 connected to a pressure hose 16 for introduction of an air stream into the pick-up head 10. A debris outlet 10*a* is provided opposite the entry of the forced air in the pick-up head 10. Outlet 10*a* is connected to a suction hose 17 having a negative pressure for drawing the air and debris into the hopper 13. The debris is separated in the hopper 13 from the air flow. The air flow is substantially recycled for reentry into the conduit 15 and pressure hose 16 for continued debris pick up.

Referring now to FIGS. II—VII, the construction of the pick-up head 10 may be appreciated. The pick-up head 10 is essentially a housing enclosed on all sides except for the bottom area adjacent the ground or surface being swept. A closed top wall or panel 20 of generally rectangular shape has a leading or forward edge 21, a trailing or rear edge 22, a first side edge 23 and a second side edge 24. A circular opening 25 is provided in a portion of the top wall 20 adjacent the wall's first side edge 23 and its rear edge 22. The end portion 26 of the pressure hose 16 is sealingly connected to opening 25. Opening 25 allows entry of the forced air flow from the fan 14 into the pick-up head 10. Approximately 25 to 35 percent of the air flow from fan 14 is bled off from conduit 15 through duct 18 so that the fan 14 pulls more air out of the pick-up head 10 through the duct 17 than it returns to the pick-up head 10 through the duct 16, thereby providing a slight negative pressure between the pick-up head 10 and the atmosphere. This negative pressure causes air to be drawn into head 10 minimizing dusting and assisting the entry of light debris under the front skirt 54.

A second circular opening 28 preferably having a greater diameter than the first opening 25, is provided in a portion of the top wall 20 adjacent the second side edge 24 approximately midway between the front and rear edges 21, 22 of the wall 20. The free end portion 29 of the suction hose 17 is sealingly connected with the second opening 28 to allow egress of the air flow containing the debris from the pick-up head 10 to the hopper 13 for collection of debris.

Also provided along the exterior or top surface 20*a* of the top wall panel 20 are a pair of mounting brackets 30, 32 by which the pick-up head 10 is attached to the vehicle 11. A first mounting bracket 30 is secured to the top wall 20 near the first opening 25. The second mounting bracket 32 is secured near the second opening 28. The brackets 30, 32 may be conventional construction and may be made from commercially available angle-iron stock. Each bracket 30, 32 has two separate members 33, 34 and 35, 36 respectively, each having a free end 33*a*, 34*a*, 35*a*, 36*a* extending forwardly from the front edge 21 of the top wall 20. Pivotally secured to each pair of forwardly extending member ends is one end 37, 38 of a tow bar 40, 41 respectively. The second end 42, 43 of each tow bar 40, 41 respectively, is pivotally secured by a link pin 44, 45 to a respective chassis clamp 46, 47 attached to the underside of the vehicle 11. See FIGS. II, VI and VII.

The attachment of the pick-up head 10 to the vehicle underside further includes a conventional chain assembly 48, 49 which suspends the pick-up head from the vehicle and allows lifting of the pick-up head relative to the ground surface during transport to and from a sweeping site. The chains, 48 and 49, have slack during the sweeping operation. A respective chain assembly 48, 49 is provided on each mounting bracket 30, 32 and includes a first connecting chain portion 48*a*, 49*a* secured to the respective second member 34, 36 at their front end portions 34*a*, 36*a* respectively, and a longer second connecting chain portion 48*b*, 49*b* secured to a respective rear portion 34*b*, 36*b* of the second member 34, 36 of each mounting bracket 30, 32. The remaining end of each connecting chain portion 48*a*, 48*b*, 49*a*, 49*b* is secured to a lever mechanism 50 at the rear of the vehicle. See FIGS. I, VI, and VII.

In this particular sweeper, the pick-up head 10 is given a generally parallelogram shape such that the corner portion of the top wall 20, formed by the front edge 21 and the first side edge 23, lies ahead of or leads the corner portion of the top wall 20, formed by the front edge 21 and the second side edge 24. The angle of inclination between the forward edge 21 of the top wall 20 and a transverse vertical plane extending through the forwardmost or leading corner of the top wall 20 may be five degrees. Thus, as the vehicle moves forwardly or rearwardly in a straight line, the pick-up head will appear to move at a slight angle. It has been found that the design of a pick-up head with a leading corner is beneficial in transporting the debris through the head to the suction area of the head. The debris thus migrates in a generally rearward and transverse direction from the positive pressure side of the sweeper head to the suction or negative pressure side, e.g. curb side, for removal to the hopper.

Extending downwardly from the top wall 20 are a pair of side walls or skids 52, 53 and a front skirt 54 and a rear skirt assembly 55. During usage the pick-up head 10 is towed to slide along on the skids 52, 53. It can be seen in FIGS. IV–VII that the top wall 20 is provided along each of its edges with a downwardly extending integral flange portion 21*a*, 22*a*, 23*a*, 24*a*. A front skirt 54 is secured to the forward edge flange portion 21*a* by a plurality of spaced apart nut and bolt assemblies 56. The front skirt 54 may be constructed from a rubber material having a degree of flexibleness which allows debris to pass under the free bottom edge 57 of the front skirt 54 for entry into the pick-up head interior. The front skirt 54 is slightly greater in height than the distance to the surface being swept. Thus the lower edge 57 of skirt 54 rests on the surface when pick-up head 10 is in a resting or stopped position. When in operation, the lower edge 57 of skirt 54 is raised slightly by the incoming air flow. The skirt 54 extends the full width of the pick-up head 10 from one side wall 52 to the other side wall 53.

A solid side wall 52, 53, constructed to provide a skid for the pick-up head 10, is secured to each of the top wall flange portions 23*a*, 24*a* at the first side edge 23 and the second side edge 24 respectively. The lowermost portion of each side wall 52, 53 (see FIGS. VI and VII) is constructed to include a generally flat portion 52*a*, 53*a* along the majority of its length with the forward and rear end portions 52*b*, 52*c*, 53*b*, 53*c* being upturned to provide the skid portion of the side walls. Each side wall 52, 53 is secured to the respective top wall flange portion 23*a*, 24*a* by providing a pair of spaced slotted openings 58*a*, 58*b*, 59*a*, 59*b* in the upper portion of the respective wall 52, 53. A pair of corresponding circular openings is provided in each top wall flange portion 23*a*, 24*a* opposite respective slotted openings 58*a*, 58*b*, and 59*a*, 59*b*. A bolt 60 may then be inserted through each circular opening and the respective aligned slotted opening and secured therein by using a locking nut 61 on the threaded end of each bolt 60. The size of the slotted opening provides a limited amount of adjustment to be made in the height of the top wall 20 relative to the surface of the ground upon which the skid portion of the side walls slides. The ability to adjust the height of the pick-up head top wall 20 relative to the surface of the ground being swept allows a degree of control in the air flow velocities within the pick-up head and allows the skirts to be adjusted for wear of the skirt edges.

A rear skirt assembly 55 is secured to the flange portion 24*a* along the top wall rear edge 24. The securement may be achieved in any conventional manner such as nut and bolt combinations 62. The rear skirt assembly 55 includes an inner stiff skirt 55*a* positioned along the flange portion 22*a*, an outer flexible skirt 55*b* is positioned along the outside surface of the inner skirt 55*a*, and a skirt retainer 55*c* completes the assembly and is positioned along the upper edge exterior surface of the outer rear skirt 55*b*. The inner stiff skirt 55*a* serves as a back wall for the pick-up head 10 and is adjustable for ground or surface contact. The outer flexible rear skirt is adjusted to bend rearwardly to drag along the surface to seal uneven portions of the surface. Each skirt 55*a*, 55*b*, the retainer 55*c*, and the flange portion 22*a* include a plurality of openings (not shown) spaced apart and aligned such that a bolt 62 may be inserted through each set of aligned openings and secured therein by a nut. Each skirt 55*a*, 55*b*, and the retainer 55*c* extends the full width of the pick-up head 10 from one side wall 52 to the other side wall 53. Little or no clearance is provided between the bottom free edge of each skirt and the surface of the ground so as to provide a seal. The skirts may be made from a flexible rubber material which will not be damaged if obstruction such as bricks or rocks pass beneath the pick-up head 10. The retainer may be made from any suitable rigid material.

It can now be appreciated that the pick-up head 10 is constructed to define a substantially closed area between the top wall 20, the side walls 52, 53 and the front and rear skirts 54, 55 with the ground surface "closing" the otherwise open bottom of the area. The only true entrance to the pick-up head 10 is through the flexible front skirt 54.

Turning now to FIGS. III, IV and V in particular, the interior of the pick-up head containing the present invention may be described. A nozzle-like head or inlet 63 for releasing the forced air flow into the pick-up head 10 is situated in the first opening 25 and connected at its upper end portion 63*a* with the free end portion 26 of the pressure hose 16. The nozzle-like head or inlet 63 is arranged such that the longitudinally extending part 64 is directed away from the first side wall 52 of the pick-up head 10. See FIG. V. In this manner entering air is directed into the rearward, high-velocity sweeping chamber 74. A portion of the entering air swirls around the entrance or nozzle 63 creating turbulance which lifts and carries the debris in the area into the chamber 74. One way to accomplish this is to provide a boot 78 adjacent the inlet 63 which will provide a restriction of the entering air flow thus inducing a turbulent movement of that air flow around the inlet. Thus a full sweeping of the otherwise dead air space is insured in this portion of the pick-up head interior by the swirling movement of the air flow about the area before it passes across the head to the debris outlet. It should be appreciated that structure other than the illustrated boot may be selected to induce a swirling movement of the air flow. For example, an arrangement of deflectors around the periphery of the inlet may be used.

In the top wall second opening 28 a debris outlet 10*a* is provided by a substantially cylindrical member 66 secured in the opening 28. The lowermost end 67 of the member 66 extends a pre-determined distance into the pick-up head interior while the upper end 68 is connected with the suction hose 17. See FIG. IV. Preferably the diameter of the debris outlet opening 28 is made larger than that of the forced air inlet opening 25 in order to more effectively accommodate debris contained in the air flow being returned to the hopper area and also to accommodate a larger volume of air than is being fed into the pickup head through the inlet 63. The air flow system is desirably provided with a mechanism for bleeding off a portion of air flow from the fan 14 to the pickup head, thus requiring the fan 14 to draw fresh air from around the pick-up head 10 thereby reducing any dusting while assisting the entry of debris into the pickup head under a lifted front skirt 54. The bleed-off may merely be a smaller duct 18 leading from conduit 15 to the atmosphere. Preferrably about 25 to 35 percent of air flow is bled off through duct 18.

A deflector skirt 69 is provided around a rearward portion of the debris outlet member 66 so that the air flow and debris are kept in an area subject to the suction forces of the suction hose 17. The deflector skirt 69 may be made from a suitably rigid rubber material. Preferably it is constructed to be secured to a forward edge of the second side wall 53, extend rearwardly and along the trailing side of the debris outlet member 66 and terminate in its securement with a portion of the rear skirt assembly 55 adjacent the outlet member 66.

Extending between the forced air nozzle-like head 63 and the debris outlet member 66 in a location which substantially partitions the interior of the pick-up head into two chambers is a center skirt 70. See FIGS. III and IV. The oenter skirt 70 may be made from a suitably rigid rubber material. The selected material should be sufficiently flexible to permit movement of debris between its free bottom edge and the surface being swept, but sufficiently rigid to prevent the forced air flow from deflecting it and creating a blow-out of air and debris. As can be seen in either FIG. VI or VII, an angle-iron member 71 is mounted to the underside 20*b* of the top wall 20. The downwardly extending portion 71*a* of the angle-iron member allows the center skirt 70 to be secured thereto in any conventional manner, e.g., nut and bolt assemblies 72. The skirt 70 has a length sufficient to extend the distance from the forced air inlet head 63 to a location a selected distance from the debris outlet member 66. The positioning of the center skirt 70 is such that the entering forced air flow is directed into the chamber 74 located rearwardly of the center skirt 70. However, the skirt end 73 adjacent the debris outlet member 66 is spaced apart from the member 66 a sufficient distance to allow the forced air flow and debris to leave the rearward chamber 74 and enter the suction area around the debris outlet member 66. The height of the center skirt 70 is not uniform throughout its length. One portion 70*a* of the skirt 70 near the forced air inlet 63 has a first height with a relatively low clearance with respect to the surface of the ground. A portion 70*b* of the skirt 70 near the debris outlet member 66 has a second height which is shorter than the first height thus providing greater clearance in this area between the skirt lowermost edge 70*c* and the ground surface. See FIG. IV. This stepped design for the skirt edge 70*c* concentrates the entering forced air flow within the rearward chamber 74 while allowing the air flows in the two chambers to be more balanced in the area near the debris outlet member 66 for entry into the suction hose. For example, if the clearance of the skirt is too great near the inlet 63 the effectiveness of the high-velocity air flow in the rearward portion of the pickup head may be adversely affected. If the clearance is insufficient, e.g. too near the ground surface, a blow-out of high-velocity air from the rearward portion 74 under the center skirt into the forward portion 75 may occur. Such a blow-out would adversely affect the pickup of lighter debris within the pickup head. Near the debris outlet 66 the clearance of the center skirt 70 is less critical and thus a balancing of air flow velocities between the two sweeping chambers 74, 75 may be allowed as the flows converge at this end of the pickup head.

The two sweeping chambers, a rearward and a forward chamber 74, 75 respectively, created by the center skirt 70 take on distinct operating characteristics when the volume of the rearward chamber 74 is reduced as compared to that of the forward chamber 75. To increase the velocity of the forced air flow in the rearward section 74 the ceiling of the rearward chamber 74 is lowered to reduce its volume. A filler piece 76 is fastened to the underside 20*b* of the top wall 20 between the forced air inlet 63 and the debris outlet 66. See FIGS. III and V. The filler piece 76 may be made from a piece of sheet metal 80 and may be supported in place by any conventional fastener, e.g., bolts 77. The bolts 77 are rotatably secured to sheet metal or flat portion 80 and may serve as a screw mechanism to increase and decrease the effective height of filler 76 relative to the surface being swept. In this embodiment the filler piece 76 has a first flexible end boot 78 secured to the top wall 20 near the pressure inlet 63, and second flexible boot 79 extending generally downwardly at the opposite side of head 10. The boots may be secured in place such as with bolts or rivets. The air space 83 located between the filler piece 76 and the top wall panel 20 becomes a dead air space which is not used in the sweeping operation. Preferably, the filler piece 76 will reduce the height of the rearward chamber 74 by approximately twenty-five to thirty percent.

Operation of the Present Invention

When it is desired to use the sweeper 12 it is properly mounted on a vehicle 11 and the pick-up head 10 connected to the vehicle 11, the pressure hose 16 and the suction hose 17 as shown in FIG. I. To begin the sweeping of debris into the hopper 13 the fan 14 is turned on and air is forced through the conduit 51 and pressure hose 16 into the pick-up head 10. When the forced air enters the pick-up head 10 from the nozzle-like head 63, it is initially directed downwardly to the ground surface where a portion swirls about the area immediately below and around the nozzle-like inlet 63. The majority of the air flow is forced along the surface of the ground by the continual entry of additional forced air. The forced air flow is directed by the center skirt 70 through the rearward chamber 74 where its velocity is increased due to the reduction in volume caused by the addition of the filler piece 76, in this chamber 74. In this chamber 74 relatively heavy debris, e.g, pea gravel, sand, broken glass, flattened cans, etc., are effectively swept or transported across the chamber 74 by the high-velocity air flow. The present invention forces the entering air flow to move along the surface of the ground at a velocity sufficient to transport the relatively heavy debris without blowing air out under the rear skirt assembly 55 or the center skirt 70. The transported heavier debris is moved through the rearward chamber 74 towards the debris outlet 66 where it is drawn up into the outlet member 66 and collected in the hopper 13. The movement of the debris through the chambers is also enhanced by the canted surfaces of the pickup head relative to the direction of travel of the sweeper. Such surfaces assist in advancing the debris towards the suction outlet.

At the same time that the heavier debris is being transported or swept by the high-velocity air flow in the rearward chamber 74, the lighter debris is swept by the air flow found in the forward chamber 75. The forward chamber 75 has a greater volume than the rearward chamber 74 and does not receive a forced air flow from the nozzle-like head 63. This chamber 75 is a low-velocity air chamber. The air flow found within the low-velocity chamber is sufficient to move relatively light debris, e.g., dust, paper, leaves, straw, to the debris outlet. This air flow is created by the suction forces of the debris outlet 66 drawing air from the atmosphere outside the pick-up head 10 into the forward chamber 75 under the front skirt 54 to make up for the portion of the air flow which has been bled off. Heavier debris entering under the front skirt into the low-velocity chamber 75, which cannot transported by the air flow in that chamber 75, moves rearwardly relative to pick-up head 10 under the center skirt 70 into the high-velocity chamber 75 where it is effectively swept to the debris outlet 66. Thus, without the use of any brushes or brooms, debris of varying densities and sizes may be swept by a single pick-up head in a single pass of the head over the surface.

Furthermore, if desired as determined by the type of debris to be swept, the air flow in each chamber 74, 75 may be further controlled by the height adjustment features of the invention. The top wall 20 may be raised or lowered by the slotted mounting of the end skids in order to maintain the front and rear skirt edges in contact with the ground surface. The filler piece 76 may be fastened to reduce the volume in the rearward chamber 74 by any percent necessary to achieve the air flow conditions necessary to transport heavier debris to the suction outlet. In this manner, the present invention solves the problems of the prior art sweepers by providing a mechanism which, without use of excess power, provides a path the full width of the pick-up head to be swept in a single pass while sweeping all the debris no matter what the range in debris densities and sizes may be. Of course, variations by those skilled in the art may be possible but such modifications are believed to be within the spirit and scope of the invention as set forth in the claims which follow.

What is claimed is:

1. Apparatus for sweeping debris from a surface, the apparatus having a housing with a substantially closed top, a source of positive pressure air flow including an inlet into said housing directed towards the surface for movement essentially transverse to the direction of travel of the apparatus, a source of negative pressure air flow including an outlet from said housing opposite said source of positive pressure air flow, a forwardmost debris transporting section, a rearwardmost debris transporting section, and a skirt separating said sections and extending between said sources of pressure air flow, said skirt allowing relatively heavy debris to pass thereunder from said forwardmost section to said rearwardmost section;

means, in said rearwardmost section extending between said sources of pressure air flow, for decreasing the cross-sectional area of the flow path in said section and creating a velocity differential between said sections, said cross-sectional area being defined by said means, said surface, said skirt, and the rear side of said housing.

2. The apparatus of claim 1 wherein said cross sectional area decreasing means includes a member secured to said housing top, said member having a substantially solid surface.

3. The apparatus of claim 1 wherein said source of positive air flow includes means for inducing a swirling movement of air flow such that sweeping of debris is achieved across and around said inlet of said positive source of pressure air flow.

4. The apparatus of claim 3 wherein the inlet of said source of positive pressure air flow includes a nozzle-like head with means therein for allowing egress of a pressurized air flow therefrom, said head extending into said rearwardmost section.

5. The apparatus of claim 4 wherein said source of negative pressure air flow includes a member having inlet means for receiving from each of said sections an air flow and debris, said negative pressure inlet means being constructed and arranged to accommodate a greater mass of air flow than said positive pressure head.

6. The apparatus of claim 1 wherein said means for decreasing the cross-sectional area including means for adjusting the velocity differential between said sections, including means for adjusting each of said sections relative to said surface as determined by the size and density of the debris being swept.

7. The apparatus of claim 6 wherein said apparatus includes a pair of skids for supporting said apparatus on the surface being swept during use.

8. The apparatus of claim 7 wherein said adjusting means comprise means for adjusting the height of said apparatus with respect to said skids.

9. The apparatus of claim 6 wherein said adjusting means comprise an adjustable filler piece disposed in the rearwardmost of said sections.

10. The apparatus of claim 1 wherein said skirt has a length and is constructed and arranged to have a non-uniform height therealong, said skirt having a first portion with a first height near said positive source of pressure air flow and a second portion with a second height at said negative source of pressure air flow, said first height being greater than said second height with a greater ground clearance being provided between said second portion and the surface than between said first portion and the surface.

11. Apparatus for sweeping debris from a surface, said apparatus comprising:

a housing having a substantially closed top, a generally open bottom, and a plurality of side walls depending from said top;

a source of positive pressure air flow in said top adjacent one of said side walls;

a source of negative pressure air flow in said top adjacent a second side wall and opposite said source of positive pressure air flow;

a leading, debris-sweeping section extending between said sources of pressure air flow and forward from said positive pressure air flow source;

a trailing, debris-sweeping section extending between said sources of pressure air flow;

a skirt separating said sections from each other, said skirt being constructed and arranged to allow relatively heavy debris to pass thereunder to said trailing section; and means, in said trailing section, for creating a velocity differential between said sections, said means including a member having a solid surface, said member effectively reducing the cross-sectional area of the flow path of said trailing section thereby increasing the velocity of the air flow therein.

12. The apparatus of claim 11 wherein said positive source of pressure air flow includes means for inducing a swirling movement of air therearound, including an outlet having a nozzle-shaped head with said head extending into said trailing section.

13. The apparatus of claim 11 wherein said skirt has a length and is constructed and arranged to have a non-uniform height along said length, said skirt including a first portion having a first height near said source of positive pressure air flow, and a second portion having a second height near said source of negative pressure air flow, said second height being less than said first height, whereby said second portion is located further from the surface than said first portion.

14. The apparatus of claim 12 wherein said inducing means comprise a restriction in the cross-section of the air flow at said nozzle-shaped head and deflector surfaces around the periphery of said head.

* * * * *